US009928773B2

(12) United States Patent
Kim et al.

(10) Patent No.: US 9,928,773 B2
(45) Date of Patent: Mar. 27, 2018

(54) DEGRADATION COMPENSATION APPARATUS, DISPLAY DEVICE INCLUDING THE DEGRADATION COMPENSATION APPARATUS, AND DEGRADATION COMPENSATION METHOD

(71) Applicant: Samsung Display Co., Ltd., Yongin (KR)

(72) Inventors: Jae Shin Kim, Seoul (KR); Jun Han Ko, Anyang-si (KR); Jong Woong Park, Yongin-si (KR); Gun Hee Chung, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 317 days.

(21) Appl. No.: 14/728,524

(22) Filed: Jun. 2, 2015

(65) Prior Publication Data

US 2016/0191952 A1 Jun. 30, 2016

(30) Foreign Application Priority Data

Dec. 31, 2014 (KR) ..... 10-2014-0195604

(51) Int. Cl.
*G09G 3/32* (2016.01)
*G09G 3/3208* (2016.01)
*G09G 3/3233* (2016.01)

(52) U.S. Cl.
CPC ..... *G09G 3/3208* (2013.01); *G09G 3/3233* (2013.01); *G09G 2320/0233* (2013.01);
(Continued)

(58) Field of Classification Search
CPC ..... H03M 7/30; H03M 7/3084; H03M 7/40
See application file for complete search history.

(56) References Cited

U.S. PATENT DOCUMENTS 8,922,595 B2 12/2014 Ahn et al.
2006/0267893 A1* 11/2006 Kim ..... G09G 3/3611 345/89

(Continued)

FOREIGN PATENT DOCUMENTS

JP 2006-235323 9/2006
KR 10-2011-0070392 6/2011

(Continued)

*Primary Examiner* — Olga Merkoulova
(74) *Attorney, Agent, or Firm* — H.C. Park & Associates, PLC

(57) ABSTRACT

A degradation compensation apparatus including: a calculator provided with gray data regarding a plurality of consecutive frames, the calculator calculating and outputting a frame degradation amount of a current frame, which indicates a degree of degradation of the current frame; a memory accumulating and storing the frame degradation amount of the current frame and outputting a cumulative degradation amount, which is an accumulated degree of degradation of frames up to the current frame; and a data corrector correcting the gray data for a subsequent frame based on the cumulative degradation amount. Each of the plurality of consecutive frames includes first and second blocks each having a plurality of pixels, and the frame degradation amount is calculated based on one of the pixels included in the first block and one of the pixels included in the second block.

12 Claims, 8 Drawing Sheets

(52) U.S. Cl.
CPC ... *G09G 2320/043* (2013.01); *G09G 2340/16* (2013.01); *G09G 2350/00* (2013.01); *G09G 2360/16* (2013.01)

(56) References Cited

U.S. PATENT DOCUMENTS

| | | | | |
|---|---|---|---|---|
| 2009/0040311 | A1* | 2/2009 | Okamoto | H04N 17/004 348/181 |
| 2009/0189924 | A1* | 7/2009 | Ogura | G09G 3/3233 345/690 |
| 2011/0026585 | A1* | 2/2011 | Watanabe | H04N 17/004 375/240.2 |
| 2012/0105502 | A1* | 5/2012 | Yokoyama | G09G 3/20 345/690 |
| 2014/0071189 | A1* | 3/2014 | Park | G09G 5/02 345/694 |
| 2016/0086548 | A1* | 3/2016 | Maeyama | G09G 3/3258 345/690 |

FOREIGN PATENT DOCUMENTS

| | | |
|---|---|---|
| KR | 10-2012-0094736 | 8/2012 |
| KR | 10-2014-0032809 | 3/2014 |

* cited by examiner

FIG. 6

FR2

| | | | |
|---|---|---|---|
| BL11_11 | BL11_12 | BL12_11 | BL12_12 |
| BL11_21 | BL11_22 | BL12_21 | BL12_22 |
| BL21_11 | BL21_12 | BL22_11 | BL22_12 |
| BL21_21 | BL21_22 | BL22_21 | BL22_22 |

DEGRADATION COMPENSATION APPARATUS, DISPLAY DEVICE INCLUDING THE DEGRADATION COMPENSATION APPARATUS, AND DEGRADATION COMPENSATION METHOD

CROSS-REFERENCE TO RELATED APPLICATION

This application claims priority from and the benefit of Korean Patent Application No. 10-2014-0195604, filed on Dec. 31, 2014, which is hereby incorporated by reference for all purposes as if fully set forth herein.

BACKGROUND

Field

Exemplary embodiments relate to a degradation compensation apparatus, a display device including the degradation compensation apparatus, and a degradation compensation method.

Discussion of the Background

The importance of display devices has steadily grown with recent developments in multimedia technology. As a result, a variety of display devices, such as a liquid crystal display (LCD) device, an organic electroluminescent (EL) display device, and the like, have been developed and widespread.

The organic EL display device, which is a display device emitting light by electrically exciting a phosphorous organic compound, displays an image by voltage- or current-programming a plurality of organic light-emitting diodes (OLEDs) that are arranged in a matrix form. A driving method of the organic EL display device may be classified into a passive matrix-type driving method and an active matrix-type driving method using thin-film transistors (TFTs). According to the passive matrix-type driving method, anodes and cathodes are arranged to be orthogonal to each other so that a desired line to be driven is selected. According to the active matrix type driving method, TFTs are coupled to respective indium tin oxide (ITO) pixel electrodes so that the organic EL display device is driven by a voltage maintained by the capacitance of a capacitor coupled to the gate of each of TFTs.

However, the efficiency of the organic EL display device may vary over time as a result of the degradation of the OLEDs, and thus, the organic EL display device may not be able to display an image with a desired luminance. More specifically, the OLEDs may gradually degrade over time, and may thus emit light with a lower luminance in response to the same data signal.

To compensate for a luminance decrease caused by the degradation of the OLEDs, an additional unit may be required. Also, for a proper operation of the additional unit, gray data regarding each area in an image input to the organic EL display device may need to be stored.

However, since not all images input to the organic EL display device can be stored, the storage of gray data regarding each input image is a critical issue.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a degradation compensation apparatus and method capable of guaranteeing degradation compensation performance without the need to store all information regarding an input image.

Exemplary embodiments also provide a display device including a degradation compensation apparatus capable of guaranteeing degradation compensation performance without the need to store all information regarding an input image.

Additional aspects will be set forth in the detailed description which follows, and, in part, will be apparent from the disclosure, or may be learned by practice of the inventive concept.

An exemplary embodiment of the present invention discloses a degradation compensation apparatus including: a calculator provided with gray data regarding a plurality of consecutive frames and calculating and outputting a frame degradation amount of a current frame, which indicates a degree of degradation of the current frame; a memory accumulating and storing the frame degradation amount of the current frame and outputting a cumulative degradation amount, which is an accumulated degree of degradation of frames up to the current frame; and a data corrector correcting the gray data for a subsequent frame based on the cumulative degradation amount. Each of the consecutive frames includes first and second blocks each having a plurality of pixels, and the frame degradation amount is calculated based on one of the pixels included in the first block and one of the pixels included in the second block.

An exemplary embodiment of the present invention also discloses a display device including: a data driver generating a data signal based on second image data; a pixel unit including a plurality of pixels, which generate light based on the data signal; and a degradation compensation unit receiving first image data from an external source and generating the second image data to compensate for degradation of the pixels. The degradation compensation unit includes: a calculator receiving gray data regarding a plurality of frames included in the first image data and calculating and outputting a frame degradation amount of a current frame, which indicates a degree of degradation of the current frame; a memory accumulating and storing the frame degradation amount of the current frame and outputting a cumulative degradation amount, which is an accumulated degree of degradation of frames up to the current frame; and a data corrector correcting the gray data for a subsequent frame based on the cumulative degradation amount. Each of the plurality of consecutive frames includes first and second blocks each having a plurality of pixels and the frame degradation amount is calculated based on one of the pixels included in the first block and one of the pixels included in the second block.

An exemplary embodiment of the present invention also discloses a degradation compensation method including: receiving gray data regarding a plurality of consecutive frames; calculating a frame degradation amount of a current frame, which indicates a degree of degradation of the current frame; outputting the calculated frame degradation amount; accumulating and storing the frame degradation amount of the current frame and obtaining a cumulative degradation amount, which is an accumulated degree of degradation of frames up to the current frame; and correcting the gray data for a subsequent frame based on the cumulative degradation amount. Each of the consecutive frames includes first and second blocks each having a plurality of pixels, and the calculating the frame degradation amount includes calculating the frame degradation amount based on one of the pixels included in the first block and one of the pixels included in the second block.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

FIG. 6 is a diagram illustrating a second frame according to an exemplary embodiment of the invention.

DETAILED DESCRIPTION OF THE ILLUSTRATED EMBODIMENTS

Figure 1:
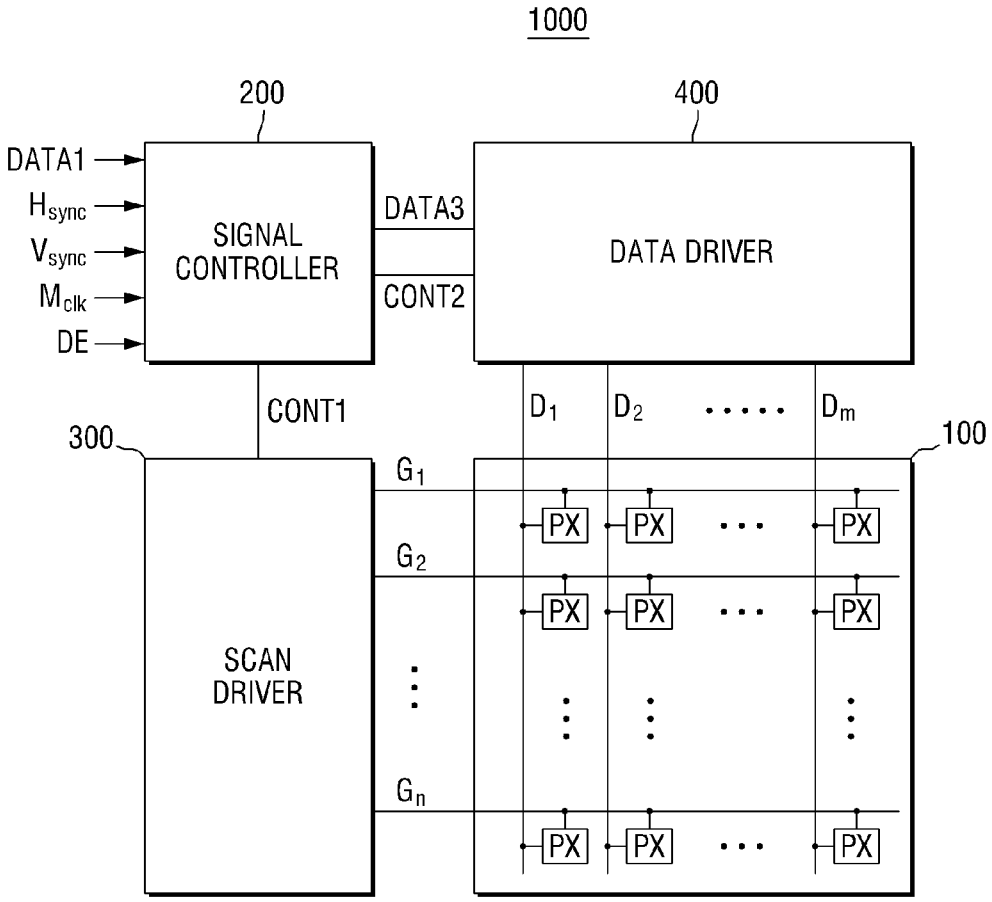
FIG. 1 is a block diagram of a display device according to an exemplary embodiment of the invention.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Exemplary embodiments will hereinafter be described with reference to the accompanying drawings.

FIG. 1 is a block diagram of a display device according to an exemplary embodiment of the invention.

Referring to FIG. 1, a display device 1000 includes a signal controller 200, a data driver 400, a gate driver 300, and a pixel unit 100.

The pixel unit 100 includes a plurality of gate lines $G_1$ through $G_n$, a plurality of data lines $D_1$ through $D_m$ and a plurality of pixel PX. Each of the gate lines $G_1$ through $G_n$ transmits a gate signal, and each of the data signals $D_1$ through $D_m$ transmits a data signal. The pixels PX are formed at the intersections between the gate lines $G_1$ through $G_n$ and the data lines $D_1$ through $D_m$.

Each of the pixels PX may include one or more organic light-emitting diodes (OLEDs). In the case where a color display is implemented by a spatial sum, red, green, and blue pixels PX may be alternately arranged in a row direction or a column direction, or may be arranged at positions corresponding to three vertices of a triangle.

The signal controller 200 receives various signals from an external source (not illustrated), and may control the gate driver 300 and the data driver 400 based on the received signals. More specifically, the signal controller 200 receives first image data DATA1 and input control signals for controlling the display of the first image data DATA1 from the external source, and outputs a gate driver control signal CONT1, a data driver control signal CONT2, and third image data DATA3.

The first image data DATA1 may include luminance information regarding each of the pixels PX of the pixel unit 100. Luminance may have a pre-defined number of gray levels, for example, 1024 ($=2^{10}$), 256 ($=2^8$) or 64 ($=2^6$) gray levels, but the invention is not limited thereto. The first image data DATA1 may be divided into one or more frames.

Examples of the input control signals, which are received by the signal controller 200, include a vertical synchronization signal $V_{sync}$, a horizontal synchronization signal, a main clock signal $M_{clk}$, and a data enable signal DE, but the invention is not limited thereto.

The gate driver control signal CONT1 controls an operation of the gate driver 300, and is generated by the signal controller 200 and transmitted to the gate driver 300. Examples of the gate driver control signal CONT1 include a scan start signal and a clock signal, but the invention is not limited thereto.

The data driver control signal CONT2 controls an operation of the data driver 400, and is generated by the signal controller 200 and transmitted to the data driver 400.

The signal controller 200 may perform image processing on the first image data DATA1 based on the input control signals according to a set of operating conditions for the data driver 400. That is, the signal controller 200 may generate and output the third image data DATA3 by subjecting the first image data DATA1 to an image processing process, such as luminance compensation. More specifically, the signal controller 200 may include a degradation compensation unit 210, which compensates for degradation of the display device 1000, and may perform various image processing processes other than degradation compensation. The structure and operation of the signal controller 200 will be described later in detail with reference to FIG. 2.

The gate driver 300 is connected to the pixel unit 100 via the gate lines $G_1$ through $G_n$. The gate driver 300 generates a plurality of gate signals, which may activate the pixels PX of the pixel unit 100 according to the gate driver control signal CONT1, and may apply the gate signals to the gate lines $G_1$ through $G_n$, respectively.

The data driver 400 may be implemented as an integrated circuit (IC) mounted on the pixel unit 100 via a contact pad (not illustrated), or as a tape carrier package (TCP) connected to the pixel unit 100.

Figure 2:
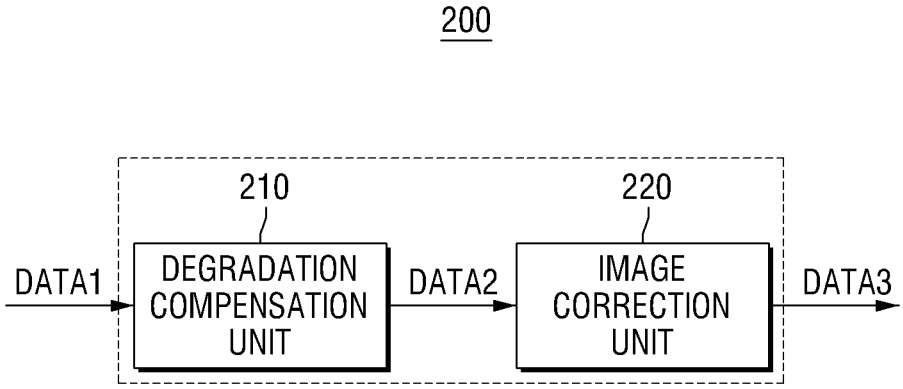
FIG. 2 is a block diagram of a signal controller according to an exemplary embodiment of the invention.

FIG. 2 is a block diagram of a signal controller according to an exemplary embodiment of the invention.

Referring to FIG. 2, the signal controller 200 may include the degradation compensation unit 210 and an image compensation unit 220.

The degradation compensation unit 210 may receive the first image data DATA1 from an external host (not illustrated), and may output second image data DATA2. More specifically, the first image data DATA1 may be provided by the host, and may include luminance information regarding each pixel of an image to be displayed. The second image data DATA2 may be calculated based on the first image data DATA1 so as to compensate for degradation of the display device 1000. The generation of the second image data DATA2 will be described later in detail with reference to FIG. 3.

The degradation compensation unit 210 may be provided in the signal controller 200, as illustrated in FIG. 2, but the invention is not limited thereto. That is, the degradation compensation unit 210 may be mounted or formed elsewhere in the display device 1000.

The image compensation unit 220 may generate and output the third image data DATA3 by performing a compensation process, other than degradation compensation, on the second image data DATA2 provided by the degradation compensation unit 210. The third image data DATA3 may be provided to the data driver 400 so as for an image to be displayed by the display device 1000. The image compensation unit 220 may be a unit performing nearly all types of image processing processes that are well known, and thus, a detailed description thereof will be omitted.

The image compensation unit 220 may receive compensated image data provided by the degradation compensation unit 210, as illustrated in FIG. 2, but the invention is not limited thereto. That is, the image compensation unit 220 may receive image data from the host, may compensate for the received image data, and may provide the compensated image data to the degradation compensation unit 210.

Figure 3:
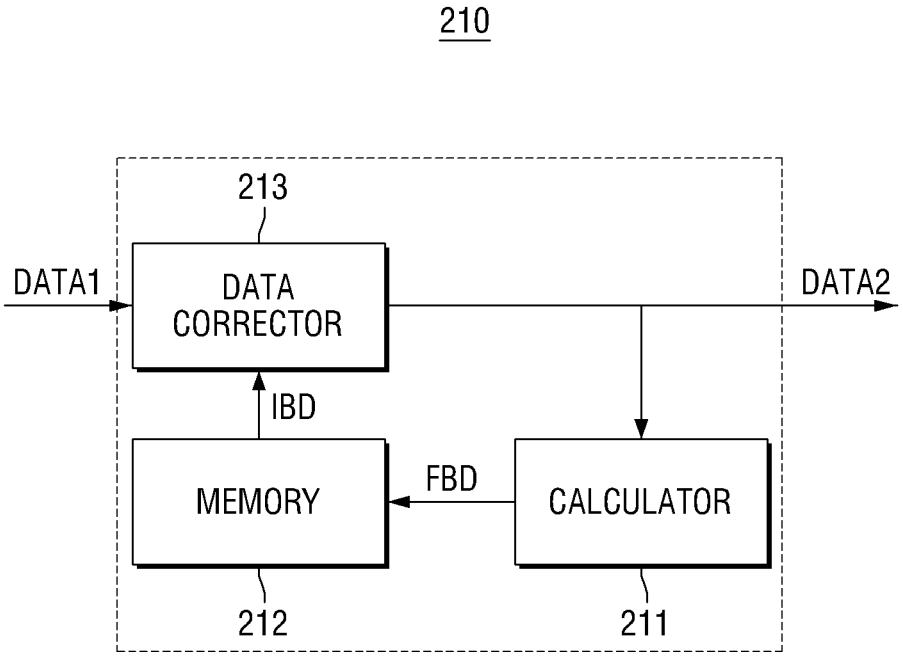
FIG. 3 is a block diagram of a degradation compensation unit according to an exemplary embodiment of the invention.

FIG. 3 is a block diagram of a degradation compensation unit according to an exemplary embodiment of the invention.

Referring to FIG. 3, the degradation compensation unit 210 may include a calculator 211, a memory 212, and a data corrector 213.

The calculator 211 may be a module for processing an amount of degradation of each frame based on an input signal yet to be compensated for. More specifically, the calculator 211 may receive the second image data DATA2 from the data corrector 213, calculate a frame degradation amount FBD of a current frame, which indicates a degree of degradation of the current frame, and output the frame degradation amount FBD. The second image data DATA2 input to the calculator 211 may be gray data regarding the current frame and a plurality of pixels of the current frame.

Various types of values may be used as the frame degradation amount FBD as long as they can provide an estimate of the degree of degradation of pixels and blocks of the current frame. For example, the frame degradation amount FBD may be the gray values of pixels included in the second image data DATA2 or may be data obtained by scaling up or down the gray values of the pixels.

Alternatively, in a case when there is no proportional relationship between gray data and the degradation of an OLED, the frame degradation amount FBD may be calculated using a conversion factor that reflects actual measurement results. In this case, the frame degradation amount FBD may be defined as a rate of decrease of the luminance of an OLED when the OLED continues to emit light with any given gray data.

The calculation of the frame degradation amount FBD need not use all the pixels of the current frame. That is, the frame degradation amount FBD may be calculated based on only part, or only some of the pixels, of the current frame. The calculation of the frame degradation amount FBD will be described later in detail with reference to FIG. 4.

The memory 212 may be a module for accumulating and storing the frame degradation amount FBD provided by the calculator 211. Also, the memory 212 may provide a cumulative degradation amount IBD, which is an accumulated degree of degradation of frames up to the current frame, to the data corrector 213 based on the accumulated FBD.

The data corrector 213 may determine a degree of degradation of each of the pixels PX of the display device 100 based on the cumulative degradation amount IBD provided by the memory 212, may correct the first image data DATA1, and may thus output the second image data DATA2.

The cumulative degradation amount IBD may be gray data regarding a predefined period of frames and pixels in each of the frames, or may be data obtained by additionally processing the gray data.

The second image data DATA2 output from the data corrector 213 may differ from the second image data DATA2 input to the calculator 211, and may be image data regarding a subsequent frame. That is, the data corrector 213 may receive, as feedback, a cumulative degradation amount IBD corresponding to the current frame, which is obtained based on second image data DATA2 corresponding to the current frame, may correct first image data DATA1 corresponding to the subsequent frame based on the received cumulative degradation amount IBD, and may output second image data DATA2 corresponding to the subsequent frame. The second image data DATA2 corresponding to the subsequent frame may also be provided back to the calculator 211. By repeating these steps, degradation compensation may be performed on the display device 1000.

The number of frames used for the calculator 211 to calculate the frame degradation amount FBD may differ from the number of frames corrected by the data corrector 213. More specifically, the data corrector 213 may perform correction on gray data regarding all the frames included in the first image data DATA1. On the other hand, the calculator 211 may calculate the frame degradation amount FBD based on gray data regarding only some of the frames included in the second image data DATA2 output by the data corrector 213. For example, in a case when an image is driven by the first image data DATA1 and the second image data DATA2 at a frequency of 60 Hz, the data corrector 213 may also be driven at a frequency of 60 Hz, but the calculator 211 may be driven at a frequency of 1 Hz. That is, the frame degradation amount FBD may be calculated using gray data regarding only one of a total of sixty frames included in the second image data DATA2.

As mentioned above, the frame degradation amount FBD may be calculated based on only part, or only some pixels, of the current frame, and this will hereinafter be described.

Figure 4:
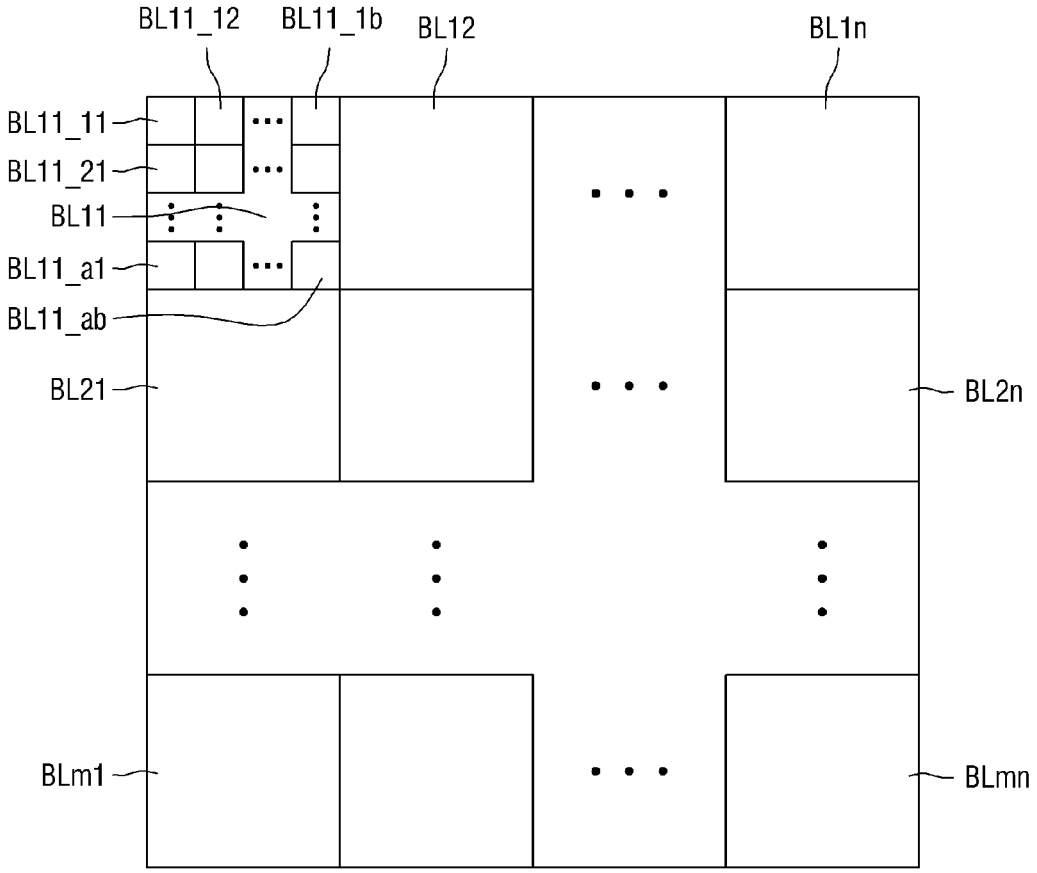
FIG. 4 is a diagram illustrating a frame according to an exemplary embodiment of the invention.

FIG. 4 is a diagram illustrating a frame according to an exemplary embodiment of the invention.

The display device 1000 may display an image corresponding to the first image data DATA1 provided by the host, and the image may include a plurality of frames that are consecutively displayed. An example of one of the plurality of frames of the image is illustrated in FIG. 4.

Referring to FIG. 4, a frame may include a plurality of blocks BL11 through BLmn, and each of the blocks BL11 through BLmn may include a plurality of pixels. The frame may include m blocks in a column direction and n blocks in a row direction. That is, the frame may include a plurality of blocks ranging from the block BL11 in a first row and a first column of the frame to the block BLmn in an m-th row and an n-th column of the frame, and each of the blocks BL11 through BLmn may include a plurality of pixels. For example, the block BL11 may include a plurality of pixels ranging from a pixel BL11_11 in a first row and a first column of the block BL11 to a pixel BL11_ab in an a-th row and a b-th column of the block BL11.

Each of the blocks BL11 through BLmn may be the minimum unit in which the cumulative degradation amount IBD is stored and output in the memory 212. More specifically, as a result of its limited storage capacity, the memory 212 cannot store gray data regarding all frames and all pixels. Therefore, a plurality of pixels may be grouped into one or more blocks, and the cumulative degradation amount IBD may be stored and managed in units of the blocks. Accordingly, the required storage capacity of the memory 212 may be considerably reduced.

Also, as described above, the cumulative degradation amount IBD may be generated by accumulating and storing the frame degradation amount FBD provided by the calculator 211. Because the frame degradation amount FBD is calculated based on only some pixels of the current frame, the required storage capacity of the memory 212 may be further reduced, and this will hereinafter be described in detail with reference to FIGS. 5, 6 and 7.

Figure 5:
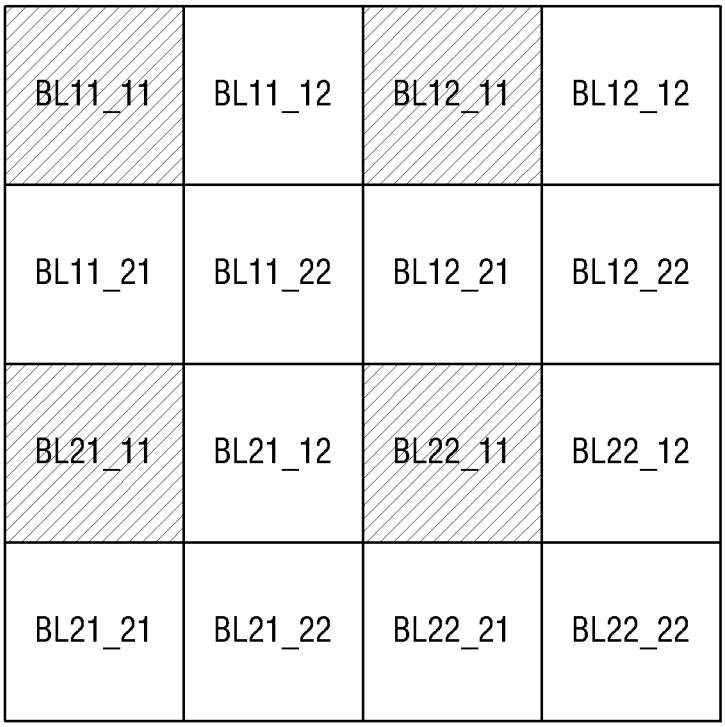
FIG. 5 is a diagram illustrating a first frame according to an exemplary embodiment of the invention.
Figure 7:
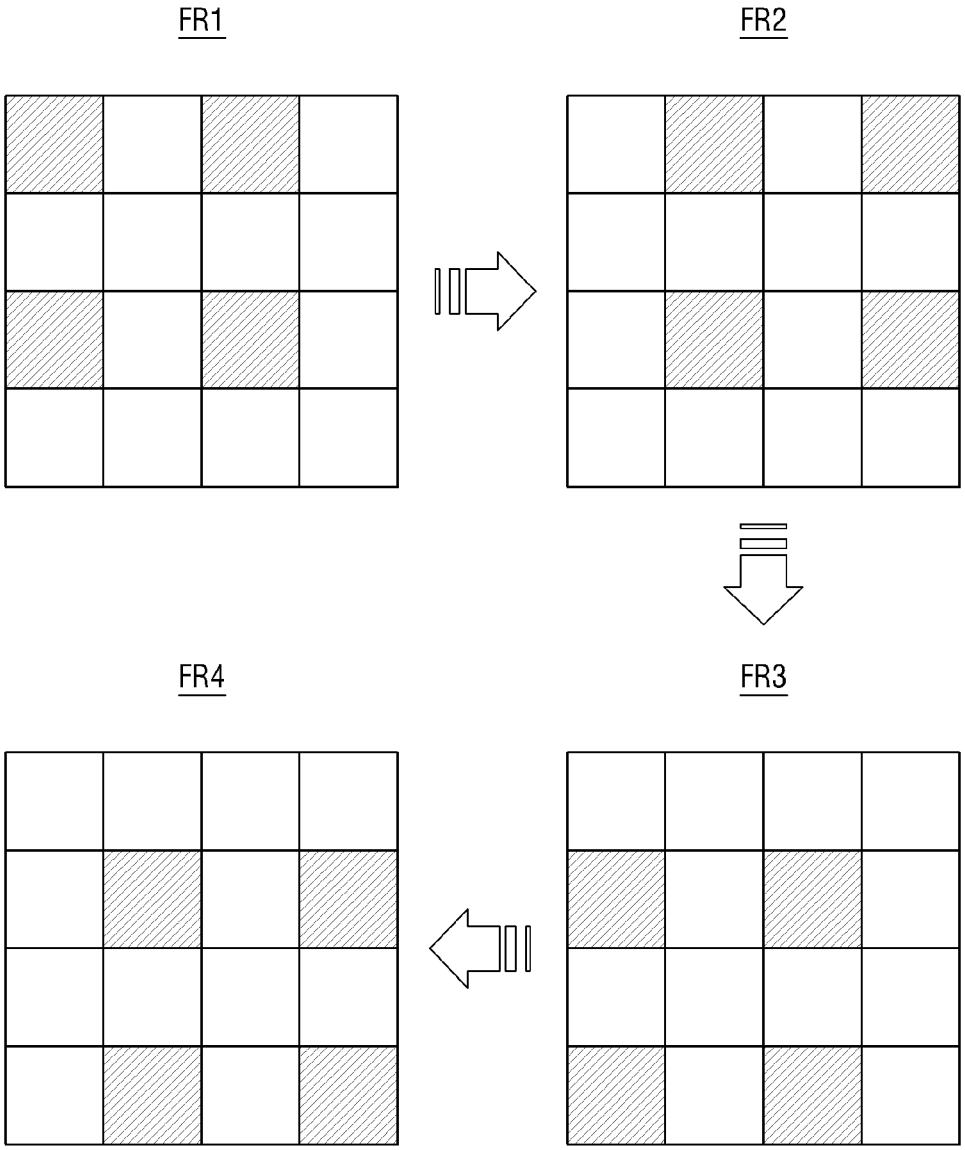
FIG. 7 is a diagram illustrating a group of a plurality of frames according to an exemplary embodiment of the invention.

FIG. 5 is a diagram illustrating a first frame according to an exemplary embodiment of the invention, FIG. 6 is a diagram illustrating a second frame according to an exemplary embodiment of the invention, and FIG. 7 is a diagram illustrating a group of a plurality of frames according to an exemplary embodiment of the invention.

Referring to FIGS. 5, 6 and 7, each frame may include, for example, two blocks in a row direction and two columns in a column direction, and each of the blocks may include, for example, two pixels in the row direction and two pixels in the column direction.

Referring to FIG. 5, pixels shaded with slanting lines, i.e., pixels BL11_11, BL12_11, BL21_11, and BL22_11, may be used to calculate a frame degradation amount FBD of a first frame FR1. That is, to calculate a degradation amount of a block (i.e., a block BL11) in a first row and a first column of the first frame FR1, a pixel (i.e., the pixel BL11_11) in a first row and a first column of the block BL11 may be used; to calculate a degradation amount of a block (i.e., a block BL12) in the first row and a second column of the first frame FR1, a pixel (i.e., the pixel BL12 11) in a first row and a first column of the block BL12 may be used; to calculate a degradation amount of a block (i.e., a block BL21) in a second row and the first column of the first frame FR1, a pixel (i.e., the pixel BL21_11) in a first row and a first column of the block BL21 may be used; and to calculate a degradation amount of a block (i.e., a block BL22) in the second row and the second column of the first frame FR1, a pixel (i.e., the pixel BL22_11) in a first row and a first column of the block BL22 may be used. Accordingly, the degradation amounts of all four blocks of the first frame FR1 may be calculated using one pixel from each of the four blocks, and the calculator 211 may provide the results of the calculation to the memory 212 as the frame degradation amount FBD of the first frame FR1.

The frame degradation amount FBD of the first frame FR1, provided to the memory 212, may be stored in units of blocks, and the cumulative frame degradation IBD, which is obtained by accumulating the frame degradation amount FBD of the first frame FR1, may also be generated in units of the blocks. Accordingly, the data corrector 213 may perform degradation compensation on gray data regarding a subsequent frame in units of the blocks.

Referring to FIG. 6, pixels shaded with slanting lines, i.e., the pixels BL11_12, BL12_12, BL21_12, and BL22_12, may be used to calculate a frame degradation amount FBD of a second frame FR2. That is, to calculate a degradation amount of a block (i.e., the block BL11) in a first row and a first column of the second frame FR2, a pixel (i.e., the pixel BL11_12) in a first row and a second column of the block BL11 may be used; to calculate a degradation amount of a block (i.e., the block BL12) in the first row and a second column of the second frame FR2, a pixel (i.e., the pixel BL12_12) in a first row and a second column of the block BL12 may be used; to calculate a degradation amount of a block (i.e., the block BL21) in a second row and the first column of the second frame FR2, a pixel (i.e., the pixel BL21_12) in a first row and a second column of the block BL21 may be used; and to calculate a degradation amount of a block (i.e., the block BL22) in the second row and the second column of the second frame FR2, a pixel (i.e., the pixel BL22_12) in a first row and a second column of the block BL22 may be used.

The frame degradation amount FBD of the second frame FR2, like the frame degradation amount FBD of the first frame FR1, may be calculated using one pixel from each of the four blocks of the second frame FR2, but the pixels used to calculate the frame degradation amount FBD of the second frame FR2 may differ from the pixels used to calculate the frame degradation amount FBD of the first frame FR1.

FIG. 7 illustrates groups of pixels used to calculate the frame degradation amount FBD of the first frame FR1, the frame degradation amount FBD of the second frame FR2, a frame degradation amount FBD of a third frame FR3, and a frame degradation amount FBD of a fourth frame FR4, respectively. Referring to FIGS. 5, 6 and 7, each of the first, second, third and fourth frames FR1, FR2, FR3 and FR4 includes four blocks, and each of the four blocks includes four pixels. Accordingly, a degradation amount may be calculated for all pixels at intervals of four frames.

Each of the first, second, third, and fourth frames FR1, FR2, FR3 and FR4 is illustrated in FIGS. 5, 6 and 7 as including four blocks, each having four pixels, but the invention is not limited thereto. That is, the number of blocks included in each frame and the number of pixels included in each block may be varied. Also, the shape of blocks of each frame is not limited to a rectangular or square shape, and other shapes may be used. The frame interval at which to calculate a degradation amount for all pixels may vary depending on the number of pixels included in each block of the frame, and the number of pixels included in each block may vary from one frame to another frame.

By calculating a frame degradation amount FBD of a frame, as illustrated in FIGS. 5 to 7, the number of elements required to constitute the calculator 211 may be considerably reduced, and this will hereinafter be described in detail with reference to FIG. 8.

Figure 8:
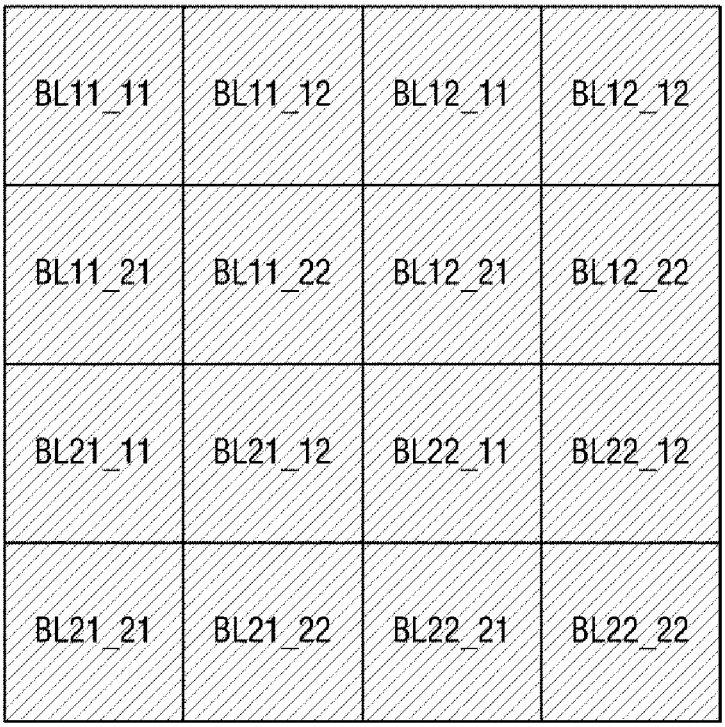
FIG. 8 is a diagram illustrating a frame according to a comparative example for explaining the exemplary embodiment of FIG. 5.

FIG. 8 is a diagram illustrating a frame according to a comparative example for explaining the exemplary embodiment of FIG. 5.

The comparative example of FIG. 8 will hereinafter be described, focusing mainly on differences with the exemplary embodiment of FIG. 5.

In the comparative example of FIG. 8, unlike in the exemplary embodiment of FIG. 5, all pixels of a frame, i.e., pixels BL11_11 through BL11_22, BL12_11 through BL12_22, BL21_11 through BL21_22, and BL22_11 through BL22_22, may all be used to calculate a frame degradation amount FBD. That is, the calculator 211 may calculate the frame degradation amount FBD of a frame based on the gray values of all the pixels of the frame, i.e., the pixels BL11_11 through BL11_22, BL12_11 through BL12_22, BL21_11 through BL21_22, and BL22_11 through BL22_22. More specifically, the calculator 211 may calculate a degradation amount of a block (i.e., a block BL11) in a first row and a first column based on all pixels included in the block BL11, i.e., the pixels BL11_11, BL11_12, BL11_21, and BL11_22, and may transmit the degradation amount of the block BL11 to the memory 212; may calculate a degradation amount of a block (i.e., a block BL12) in the first row and a second column based on all pixels included in the block BL12, i.e., the pixels BL12_11, BL12_12, BL12_21, and BL12_22, and may transmit the degradation amount of the block BL12 to the memory 212; may calculate a degradation amount of a block (i.e., a block BL21) in a second row and the first column based on all pixels included in the block BL21, i.e., the pixels BL21_11, BL21_12, BL21_21, and BL21_22, and may transmit the degradation amount of the block BL21 to the memory 212; and may calculate a degradation amount of a block (i.e., a block BL22) in the first row and the second column based on all pixels included in the block BL22, i.e., the pixels BL22_11, BL22_12, BL22_21, and BL22_22, and may transmit the degradation amount of the block BL12 to the memory 212.

Because the degradation amount of each of the blocks BL11, BL12, BL21, and BL22 is calculated using the gray values of all the pixels included in a corresponding block, a process of adding up the gray values of the pixels BL11_11 through BL11_22, the gray values of the pixels BL12_11 through BL12_22, the gray values of the pixels BL21_11 through BL21_22 and the gray values of the pixels BL22_11 through BL22_22, respectively, or a process of adding up and then averaging the gray values of the pixels BL11_11 through BL11_22, the gray values of the pixels BL12_11 through BL12_22, the gray values of the pixels BL21_11 through BL21_22 and the gray values of the pixels BL22_11 through BL22_22, respectively, may be needed. Therefore, additional physical elements such as adders or dividers or additional processes are required. Accordingly, the comparative example of FIG. 8 may inevitably incur additional cost, compared to the exemplary embodiment of FIG. 5.

Also, image data is generally input to the calculator 211 in units of rows, but each block of a frame may include more than one row. Accordingly, if a degradation amount is calculated based on all pixels included in each block of a frame, as illustrated in FIG. 8, an additional element that can perform as a memory, such as a latch or a flip-flop, may be needed. However, the exemplary embodiment of FIG. 5 requires no such additional element. That is, according to the exemplary embodiment of FIG. 5, the number of elements of the calculator 211 may be considerably reduced, and/or the calculation of a frame degradation amount FBD by the calculator 211 may be simplified.

According to exemplary embodiments, it is possible to provide a degradation compensation apparatus capable of guaranteeing degradation compensation performance without the need to store all information regarding an input image.

It is also possible to provide a display device including a degradation compensation apparatus capable of guaranteeing degradation compensation performance without the need to store all information regarding an input image.

Also, it is possible to provide a degradation compensation method capable of guaranteeing degradation compensation performance without the need to store all information regarding an input image.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A degradation compensation apparatus, comprising:

a calculator provided with gray data regarding a plurality of consecutive frames and configured to calculate and output a frame degradation amount of a current frame, which indicates a degree of degradation of the current frame;

a memory configured to accumulate and store the frame degradation amount of the current frame and to output a cumulative degradation amount, which is an accumulated degree of degradation of frames up to the current frame; and a data corrector configured to correct the gray data for a subsequent frame based on the cumulative degradation amount, wherein:

each of the plurality of consecutive frames comprises first and second blocks each comprising a plurality of pixels;

the frame degradation amount of the current frame is calculated based on one of the pixels included in the first block and one of the pixels included in the second block; and the frame degradation amount of the current frame is calculated using different pixels from those used to calculate a frame degradation amount of a previous frame.

2. The degradation compensation apparatus of claim 1, wherein the frame degradation amount is calculated using all the pixels included in each of the first and second blocks at intervals of a predetermined period.

3. The degradation compensation apparatus of claim 1, wherein the current frame further comprises a third block or one or more other blocks.

4. The degradation compensation apparatus of claim 1, wherein the frame degradation amount is accumulated and stored in units of the first and second blocks.

5. The degradation compensation apparatus of claim 1, wherein:

the data corrector is configured to correct the gray data for all the plurality of consecutive frames; and the calculator is configured to calculate the frame degradation amount for only some of the plurality of consecutive frames.

6. A display device, comprising:

a data driver configured to generate a data signal based on second image data;

a pixel unit comprising a plurality of pixels, which are configured to generate light based on the data signal; and a degradation compensation unit configured to receive first image data from an external source and to generate the second image data to compensate for degradation of the pixels, wherein the degradation compensation unit comprises:

a calculator configured to receive gray data regarding a plurality of frames included in the first image data and to calculate and output a frame degradation amount of a current frame, which indicates a degree of degradation of the current frame;

a memory configured to accumulate and store the frame degradation amount of the current frame, and to output a cumulative degradation amount, which is an accumulated degree of degradation of frames up to the current frame; and a data corrector configured to correct the gray data for a subsequent frame based on the cumulative degradation amount, wherein:

each of the plurality of consecutive frames comprises first and second blocks each comprising a plurality of pixels;

the frame degradation amount of the current frame is calculated based on one of the pixels included in the first block and one of the pixels included in the second block; and the frame degradation amount of the current frame is calculated using different pixels from those used to calculate a frame degradation amount of a previous frame.

7. The display device of claim 6, wherein the frame degradation amount is calculated using all the pixels included in each of the first and second blocks at intervals of a predetermined period.

8. The display device of claim 6, wherein the current frame further comprises a third block or one or more other blocks.

9. The display device of claim 6, wherein the frame degradation amount is accumulated and stored in units of the first and second blocks.

10. The display device of claim 6, wherein:

the data corrector is configured to correct the gray data for all the plurality of consecutive frames; and the calculator is configured to calculate the frame degradation amount for only some of the plurality of consecutive frames.

11. A degradation compensation method, comprising:

receiving gray data regarding a plurality of consecutive frames;

calculating a frame degradation amount of a current frame, which indicates a degree of degradation of the current frame;

outputting the calculated frame degradation amount;

accumulating and storing the frame degradation amount of the current frame and obtaining a cumulative degradation amount, which is an accumulated degree of degradation of frames up to the current frame; and correcting the gray data for a subsequent frame based on the cumulative degradation amount, wherein:

each of the plurality of consecutive frames comprises first and second blocks each having a plurality of pixels; and the calculating the frame degradation amount comprises:

calculating the frame degradation amount of the current frame based on one of the pixels included in the first block and one of the pixels included in the second block; and calculating the frame degradation amount of the current frame using different pixels from those used to calculate a frame degradation amount of a previous frame.

12. The degradation compensation method of claim 11, wherein:

the calculating the frame degradation amount and the obtaining the cumulative degradation amount are performed on only some of the plurality of consecutive frames; and the correcting the gray data is performed on all the plurality of consecutive frames.

* * * * *